US010486316B2

(12) United States Patent
Erndt et al.

(10) Patent No.: US 10,486,316 B2
(45) Date of Patent: Nov. 26, 2019

(54) SHAVER COUPLING AND ELECTRICAL SHAVER WITH COUPLING

(71) Applicant: Braun GmbH, Kronberg (DE)

(72) Inventors: Andreas Erndt, Kelkheim (DE); Philipp Berger, Bad Vilbel (DE); Cirilo Javier Perez Lopez, Frankfurt am Main (DE); Diana Kappes, Boston, MA (US); Detlef Gleich, Friedrichsdorf (DE); Michael Jöst, Obertshausen (DE)

(73) Assignee: Braun GMBH, Kronberg (DE)

( * ) Notice: Subject to any disclaimer, the term of this patent is extended or adjusted under 35 U.S.C. 154(b) by 63 days.

(21) Appl. No.: 15/716,456

(22) Filed: Sep. 26, 2017

(65) Prior Publication Data

US 2018/0085936 A1 Mar. 29, 2018

(30) Foreign Application Priority Data

Sep. 28, 2016 (EP) ..... 16191106

(51) Int. Cl.
*B26B 19/04* (2006.01)
*B26B 19/06* (2006.01)

(52) U.S. Cl.
CPC ..... *B26B 19/046* (2013.01); *B26B 19/048* (2013.01); *B26B 19/063* (2013.01)

(58) Field of Classification Search
CPC .... B26B 19/046; B26B 19/063; B26B 19/048
See application file for complete search history.

(56) References Cited

U.S. PATENT DOCUMENTS 3,589,005 A * 6/1971 Fischer ..... B26B 19/102 30/34.1
4,292,737 A * 10/1981 Packham ..... B26B 19/04 30/43.92
4,797,997 A 1/1989 Packman et al.
4,930,217 A * 6/1990 Wolf ..... B26B 19/048 30/34.1
4,993,152 A * 2/1991 Deubler ..... B26B 19/04 30/346.51
5,245,754 A 9/1993 Heintke et al.
5,398,412 A * 3/1995 Tanahashi ..... B26B 19/10 30/43.9
5,542,179 A * 8/1996 Beutel ..... B26B 19/048 30/43
5,564,191 A * 10/1996 Ozawa ..... B26B 19/048 30/43.91
5,579,581 A * 12/1996 Melton ..... B26B 19/063 30/223
5,606,799 A * 3/1997 Melton ..... B26B 19/063 30/199

(Continued)

FOREIGN PATENT DOCUMENTS

EP 1661672 5/2006
EP 2404716 1/2012

OTHER PUBLICATIONS

European search report dated May 17, 2017.

*Primary Examiner* — Sean M Michalski
(74) *Attorney, Agent, or Firm* — Ronald Terk Sia; Kevin C. Johnson

(57) ABSTRACT

The invention refers to a coupling for transmitting a driving movement from an oscillating transmitter of an electric shaver to a cutter element.

16 Claims, 11 Drawing Sheets

(56) References Cited

U.S. PATENT DOCUMENTS

| | | | | |
|---|---|---|---|---|
| 5,611,145 | A * | 3/1997 | Wetzel | B26B 19/044 30/43.92 |
| 5,715,601 | A * | 2/1998 | Nakatani | B26B 19/046 30/346.51 |
| 6,317,984 | B1 * | 11/2001 | Okabe | B26B 19/04 30/346.51 |
| 6,415,513 | B1 * | 7/2002 | Eichhorn | B26B 19/048 30/346.51 |
| 6,931,731 | B2 * | 8/2005 | Izumi | B26B 19/046 30/34.1 |
| 7,171,751 | B2 * | 2/2007 | Iwashita | B26B 19/02 30/346.51 |
| 7,419,494 | B2 * | 9/2008 | Hashiguchi | A45D 26/0028 30/30 |
| 8,720,069 | B2 * | 5/2014 | Iwashita | B26B 19/048 30/346.51 |
| 9,676,108 | B2 * | 6/2017 | Beugels | B26B 19/048 |
| 2018/0085955 | A1 * | 3/2018 | Krauss | B26B 19/046 |

* cited by examiner

SHAVER COUPLING AND ELECTRICAL SHAVER WITH COUPLING

FIELD OF THE INVENTION

The present invention relates to a coupling which is suitable to be used in an electric shaver. In more detail, the coupling transmits a driving movement from an oscillating transmitter of an electric shaver to a cutter element of the electric shaver. The coupling comprises at least the transmitter, the cutter element and a coupling part, wherein the coupling part comprises a seat for receiving the transmitter. Further, the invention relates to an electric shaver comprising such a coupling.

BACKGROUND OF THE INVENTION

The present invention aims in particular to a coupling for an electric shaver of the type having at least one cutter unit with a foil type upper cutter and a non-foil type lower cutter which perform a reciprocating relative movement with respect to each other when in use. In electric shavers of this type there is a general desire for adapting the cutter unit to the contour of the skin to be shaved. This is achieved by allowing a relative movement of the cutter unit with respect to the main housing or a handle of the electric shaver. A constraint in the adaption to the contour of the skin to be shaved is that the oscillating movement of a drive unit is transferred via the transmitter to a cutter element, typically the non-foil type lower cutter element.

Without such a coupling between the transmitter and the cutter element these two component parts may perform six types of relative movements corresponding to the six degrees of freedom of a rigid body, namely a translation parallel to a vertical axis (up and down), a translation parallel to a horizontal axis (left and right), a translation parallel to a further horizontal axis (forward and backward), a rotation about a vertical axis (gyration), a rotation about the horizontal axis (swiveling) and a rotation about the further horizontal axis (tilting). The further horizontal axis is defined as being perpendicular to the vertical axis and perpendicular to the horizontal axis and is referred to in the following as the tilting axis. The relative movement of the lower cutter element with respect to the upper cutter element is referred to in the following as being the movement parallel to the horizontal axis.

Regarding the orientation of the axes of an electric shaver, it is assumed in the following that the shaver is held in an upright position with a body or handle of the shaver facing downwards and a cutter unit facing upwards. With this orientation of the shaver, the vertical axis extends along the body or handle in a vertical direction, while the tilting axis and the swiveling axis extend horizontally. Although all three axes do not necessarily cross in on point they are oriented perpendicular relative to each. The term horizontal swivel axis as applied herein below includes also an axis which is parallel to that. Notwithstanding this definition of the axes, the shaver may be held and applied in any desired orientation during use.

FR 1 391 957 A describes a coupling between a driver which performs an eccentric rotational movement and a cutting element which performs a combined rotational and translational movement. The driver comprises a hemispherical tip which is smaller than a hemispherical shell of the cutting element.

EP 1 161 325 B1 suggests an electric shaver with oscillating cutting knifes which move relative to a shearing blade.

A shearing head carrying the shearing blade is driven by a drive unit to perform a gyration or tilting movement.

U.S. Pat. No. 5,715,601 discloses an electric shaver with an inner cutter driven to reciprocate relative to an outer cutter. The outer cutter is floatingly supported in a holder so as to be capable of tilting and depressing together with the inner cutter against the bias of a spring. The inner cutter is formed with a joint and catch for detachable connection to a drive unit and its pin.

EP 1 005 404 B1 discloses an electric shaver with a with a housing in which an electric drive mechanism is provided having a drive element for the transmission of a driving motion to at least one reciprocating cutting element. A shaving head is mounted on two support arms of a supporting frame for pivotal movement about the horizontal axis within a shaving head frame. The shaving head is formed by at least two cooperating cutting elements disposed in the shaving head frame.

Further examples of shaver heads pivotable about the horizontal (swiveling) axis are described in DE 10 2006 010 323 A1. One of these examples uses a con-rod mounted to an eccentric portion of a drive shaft for driving an oscillatory bridge which in turn transmits the reciprocating translational movement to a lower cutter element. The con-rod comprises a pin engaging a slot in the oscillatory bridge which slot extends perpendicular to the horizontal (swiveling) axis. An alternative example uses pin-shaped oscillators which are each coupled via a joint pushrod to an oscillatory plate which in turn transmits the reciprocating translational movement to a lower cutter element. Both examples allow swiveling of the shaver head with respect to the shaver housing while transmitting a movement to the lower cutter element(s).

Further, EP 1 661 672 A1 describes a shaver coupling for transmitting a driving movement from an oscillating transmitter extending along a vertical axis to a cutter element moving along a horizontal axis perpendicular to the vertical axis. The coupling comprises the transmitter, the cutter element and a coupling part having a seat for receiving the transmitter. The cutter element is constrained to the transmitter in a direction parallel to the horizontal axis while having a degree of freedom in at least two rotational directions for performing a swing movement and a tilting movement, respectively, and in a direction parallel to the vertical axis.

It is accordingly an object of the present invention to propose a coupling of the type mentioned above which improves the ability of adaption to the contour of the skin to be shaved while transmitting forces from a driven part of an electric shaver to a cutter element.

SUMMARY OF THE INVENTION

This object is solved with a coupling according to claim 1 and an electric shaver according to claim 13.

The present invention is based on the idea of providing several different translational and/or rotational movements of a cutter element with respect to a driven element of an electric shaver. The coupling is preferably designed to allow relative vertical translation, relative forward horizontal translation, relative gyration, relative swiveling and/or relative tilting of a cutter unit with respect to a transmitter pin on a macro level, i.e. based on a movement of the whole shaver head with respect to the housing, and/or on a micro level, i.e. based on a movement of a cutter unit relative to the shaver head and/or relative to other cutter units. This permits a perfect adaption of the position of each individual cutter unit with respect to the contour of the skin to be shaved.

According to one aspect of the present invention the transmitter, the cutter element and the coupling part are arranged and formed such that the cutter element is constrained to the transmitter in a direction parallel to the horizontal axis, i.e. transmitting a force or a motion required for the relative cutting movement of the cutter element with respect to a further cutter element, while having a degree of freedom in at least two rotational directions and in at least one translational direction parallel to the vertical axis. In a preferred embodiment, the permitted rotational movement comprises a swiveling movement about a horizontal axis and a tilting movement about a perpendicular horizontal tilting axis. In addition, a gyration about the vertical axis may be permitted. This results in an improved ability of the cutter element to adapt to the contour of the skin to be shaved. The drive unit and the transmitter moves/oscillates only in response to the motor drive activation but does not move relative to the head which is moveable in order to adapt to the skin contour any. Thus a rotational and/or axial displacement of the lower cutter relative to the head in the various drive positions and various inclined swivel and/or tilt position of the head is enabled by the coupling design between the transmitter and the lower cutter and the lower cutter may freely reciprocate relative to the upper cutter independent from the angular or lateral position of the transmitter relative to the lower cutter.

For transmitting a driving force or movement from the transmitter to the cutter element, the transmitter preferably directly abuts the coupling part. In this respect, the transmitter may comprise a cylindrical element, like a pin, received in a hole of the coupling part. The hole of the coupling part may be cylindrical or may have a polygonal inner contour.

The interface between the coupling part and the cutter element may be formed in various different ways to achieve the desired degree of freedom in the translational and rotational directions as described above. For example, the coupling part may comprise an at least in part spherical, cylindrical or ball-shaped outer surface and the cutter element may comprise a guidance chamber for receiving the outer surface such that the cutter element is constrained to the coupling part in a direction parallel to the horizontal swiveling axis while having a degree of freedom in at least two rotational directions and in at least one translational direction parallel to the vertical axis. A suitable design for the outer surface of the coupling part comprises a spherical calotte or a spherical segment which may be provided on an, e.g. cylindrical, neck portion. As an alternative, the coupling part may have an, e.g. cylindrical, neck portion with two laterally extending arcs each forming a cylinder segment.

The guidance chamber may comprise a corresponding contact surface for contacting the outer surface of the coupling part at least along a contact line, e.g. by providing a cylindrical shape of the contact surface and a spherical shape of the outer surface, or comprise a corresponding contact surface for contacting the outer surface of the coupling part along at least one contact face, e.g. by providing a spherical shape of the contact surface and a spherical shape of the outer surface.

As an alternative, the coupling part may comprise an at least in part cylindrical outer surface, while the cutter element comprises a corresponding at least in part spherical or cylindrical inner surface. Such interfaces between the coupling part and the cutter element allow a swiveling and/or tilting movement of the cutter element with respect to the coupling part. If the coupling part comprises a cylindrical outer surface and/or if the cutter element comprises a cylindrical inner surface, the longitudinal axis defining the cylindrical surfaces is preferably orientated to be parallel to the tilting axis, i.e. perpendicular to the vertical axis and perpendicular to the horizontal axis. With such an arrangement of the cylindrical surfaces a swiveling movement of the cutter element may be achieved, e.g. by swiveling of the whole shaver head and/or by swiveling of one or more individual cutter units.

In a preferred embodiment of the invention the transmitter is rotatable relative to the coupling part around the vertical axis, whereas the coupling part is rotationally constrained to the cutter element in the rotational direction around the vertical axis. For example, the transmitter comprises a pin, which may be cylindrical, and the coupling part comprises a corresponding seat in the form of an, e.g. circular, opening receiving the pin and allowing relative rotation around the vertical axis. A well-defined arrangement of the coupling part with respect to the cutter element may be suitable to allow a relative movement between the transmitter and the cutter element while reliably transmitting a force or motion from the transmitter to the cutter element. In a preferred embodiment of the invention the transmitter comprises a pin which extends along the vertical axis.

To further improve the adaption of a cutter element or a cutter unit to the contour of the skin to be shaved it may be preferred to mount the cutter element with respect to the transmitter in a resiliently floating manner. In this respect the coupling may further comprise at least one elastically deformable element, for example a compression spring, which biases the cutter element in at least one direction into a home position, preferably at least in a direction parallel to the vertical axis. This allows depressing the cutter element against the bias of the spring with respect to the transmitter.

The cutter element may be a non-foil type lower cutter element comprising a series of arched blades which are fixed on a common base. According to an embodiment of the present invention the base of the cutter element receives and/or mounts the coupling part. This includes embodiments with the coupling part merely contacting the base and embodiments with the coupling part being clipped to the base.

Allowing a swiveling movement of the cutter element, while at the same time transmitting a force or motion parallel to the horizontal axis, may require that the seat of the coupling part comprises a slotted hole. Preferably, the slotted hole has a width in the direction of the horizontal axis which at least substantially corresponds to the width of the transmitter pin in the direction of the horizontal axis. Further, the slotted hole preferably has a width in the direction of the tilting axis which exceeds the width of the transmitter pin in the direction of the tilting axis. In other words, the slotted hole extends parallel to the tilting axis. This allows direct contact of the transmitter pin with the side face of the slotted hole in the direction of the horizontal axis while allowing pivoting of the transmitter pin with respect to the coupling part.

In a further development of this embodiment the coupling part and the cutter element may comprise corresponding guide elements preventing relative rotation around the vertical axis (gyration). A guide element may have the form of a pin on the coupling part received in an, e.g. cylindrical, shell of the cutter element. The provision of any type of guide elements preventing gyration of the coupling part with respect to the cutter element maintains the slotted hole in an orientation allowing pivoting of the transmitter pin within the slotted hole for a swiveling movement of the cutter element.

As an alternative, the seat of the coupling part may be an, e.g. cylindrical, hole having a diameter substantially corresponding to the diameter of the transmitter pin with the cutter element comprising a cylindrical inner surface defined by a longitudinal axis which is parallel to the tilting axis and perpendicular to the horizontal axis and the vertical axis, respectively. This allows pivoting of the transmitter pin together with the coupling part with respect to the cutter element to allow a swiveling movement of the cutter element while transmitting a force or a movement parallel to the horizontal axis.

In a still further alternative the coupling part may comprise a bearing shell receiving the free end of the transmitter with the bearing shell being mounted to the cutter element via a con-rod which is pivotable about an axis perpendicular to the horizontal axis and perpendicular to the vertical axis. In other words, the interface between the free end of the transmitter and the bearing shell allows a degree of freedom in three rotational directions, namely gyration, swiveling and tilting. In addition, the pivotable con-rod allows a degree of freedom in at least one translational direction parallel to the vertical axis while transmitting a force of movement from the transmitter to the cutter element in a direction parallel to the horizontal axis. According to a further development of this embodiment the elastically deformable element may have the form a leg spring biasing the bearing shell away from the cutter element. Alternately, other types of torsion springs or pressure springs may be suitable.

In an alternative the cutter element, preferably the non-foil type lower cutter element, comprises a series of arched blades fixed on a common base which base forms the coupling element. In other words, the coupling part may be integrally formed with a portion of the cutter element.

In a further development of this alternative the coupling part may comprise a slotted hole having two side surfaces situated opposed to each other in the direction of the horizontal axis, which are inclined and/or bent such that a middle portion of the slotted hole has a width in the direction of the horizontal axis which substantially corresponds to the width of the transmitter pin in the direction of the horizontal axis while an upper portion and a lower portion of the slotted hole each have a width in the direction of the horizontal axis exceeding the width of the transmitter pin in the direction of the horizontal axis. Further, the slotted hole preferably has a width in the direction of the tilting axis which exceeds the width of the transmitter pin in the direction of the tilting axis. This design of the slotted hole allows transmission of a force or motion from the transmitter to the cutter element parallel to the horizontal axis while allowing pivoting of the transmitter for permitting a swiveling movement and a tilting movement of the cutter element. Variations of the design of the slotted hole include an obtuse angle between the upper and lower portion of the side surface and include an acute angle between the upper portion and lower portion of the side surfaces.

The above defined coupling is especially suitable for use in an electric shaver comprising at least one cutter unit with a foil type upper cutter and a (non-foil type) blade type lower cutter, a drive unit for generating an oscillating movement of at least one transmitter with the coupling connecting the transmitter to the blade type lower cutter. In a preferred embodiment of an electric shaver the at least one cutter unit is supported by a frame which is detachably mounted to the drive unit. It is further preferred if, when the coupling couples the transmitter to the blade type lower cutter, the frame with the cutter unit is moveable relative to the drive unit in a direction parallel to the vertical axis and rotatable relative to the drive unit about the horizontal axis (swiveling) and a bout the tilting axis which is perpendicular to the horizontal axis and perpendicular to the vertical axis. The swiveling of the drive unit may include a swiveling of the drive unit with respect to the frame and/or may include a swiveling of a shaver head comprising one or more drive units.

The shaver may comprise a housing, e.g. in the form of a body or handle, a head, preferably comprising the cutter elements, and a gimbal element which is hinged in a pivotable manner to the housing and which is hinged in a pivotable manner to the head. Preferably, the gimbal element is mounted to the housing by means of a joint allowing rotation about the swivel axis and is mounted to the head by means of a joint allowing rotation about the tilting axis.

The above object is also solved by a shaver that comprises a head and a handle, at least one cutter unit with a foil type upper cutter and a blade type lower cutter, a drive unit for generating an oscillating movement of at least one transmitter and a coupling which couples the transmitter to the blade type lower cutter, wherein the head being movably supported relative to the handle around a horizontal swivel axis and/or around a horizontal tilt axis, said swivel axis is parallel to the lower cutter movement directions and said horizontal tilt axis is perpendicular to said horizontal swivel axis and wherein spring means are provided for returning the head into a neutral, non-inclined position with respect to the swivel axis and/or the tilt axis characterized in that said lower cutter is forced against said upper cutter by spring means which at least in part contributes to the spring means for returning the head into a neutral position with respect to at least a head swivel and/or tilt movability. Thus a better return of the head to a neutral position is achieved after the head moved to adapt to the skin contour if either the one spring is used for all movability return to neutral functions or if the spring wound around the transmitter pin for keeping the under cutter in tight contact whit the upper cutter at least contributes to that return to a neutral head position function. Preferably the spring wound around the transmitter pin for keeping the under cutter in tight contact with the upper cutter also allows the cutter unit to float by compression of same and to (micro) tilt relative to the head.

Further features, advantages and possibilities of use of the present invention are described in the following with respect to preferred embodiments of the invention and the drawings. All features described and/or shown in the drawings are subject matter of the invention, irrespective of the grouping of the features in the claims and/or their back references.

DETAILED DESCRIPTION OF THE INVENTION

Figure 1:
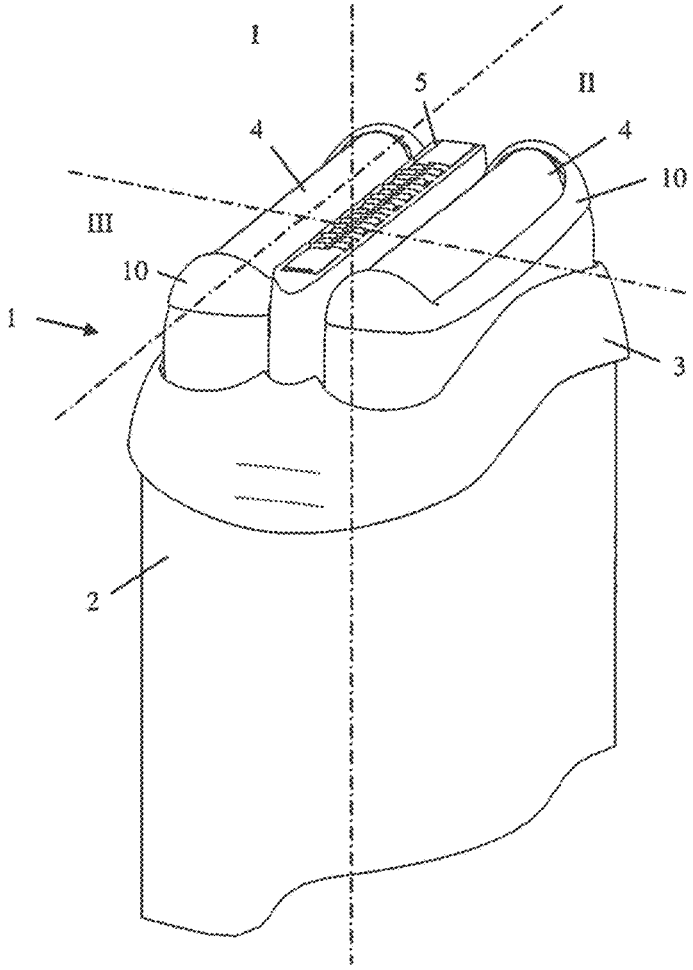
FIG. 1 is a perspective partial view of an electric shaver.

FIG. 1 depicts the upper portion of an electrical shaver 1 with a shaver housing 2 forming a handle for holding the shaver 1 and a shaver head 3 detachably mounted on the housing 2. The shaver housing 2 may have different shapes such as a substantially cylindrical shape or box shape or bone shape allowing for ergonomically grabbing and holding the shaver. In the exemplary embodiment of FIG. 1, the shaver head 3 comprises three cutter units, namely two outer shearing foil cutter units 4 and a central shearing blade cutter unit 5. Other embodiments may comprise different types of cutter units, different numbers of cutter units and/or a different arrangement of the cutter units.

Figure 2A:
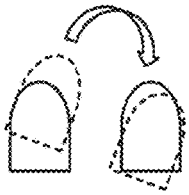
FIG. 2*a-d* are schematic side views of two cutter units in a home position and in a swiveled position.
Figure 2B:
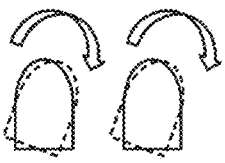
Figure 2C:
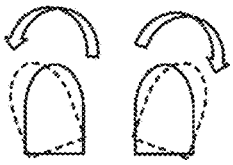
Figure 2D:
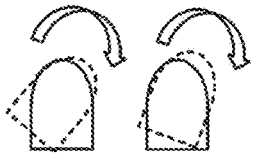

FIG. 1 further shows three axes which are each arranged perpendicular to each other, namely a vertical axis I, a horizontal axis II (also referred to as swiveling axis in the following) and a further horizontal axis III (also referred to as tilting axis in the following). The six degrees of freedom of a body are referred to in the following with reference to these axes as:

vertical translation, i.e. parallel to the vertical axis I, lateral horizontal translation, i.e. parallel to the swiveling axis II, forward horizontal translation, i.e. parallel to the tilting axis III, gyration, i.e. a rotation about an axis parallel to the vertical axis I, swiveling, i.e. a rotation about an axis parallel to the swiveling axis II, tilting, i.e. a rotation about an axis parallel to the tilting axis III, If not defined otherwise in the following, any of these movements are to be understood as movements relative to the housing 2 as a stationary basis. FIGS. 2*a* to 2*d* show by means of the example of swiveling of two cutter units that each of the above mentioned movements may result in different behaviors of the cutter units depending on their suspension and interconnection. For example, the two cutter units may swivel together with the whole shaver head about a common swiveling axis II (FIG. 2*a*) or they may swivel in unison about different axes (FIG. 2*b*) or they may swivel contrarily about different axes (FIG. 2*c*) or they may swivel independent of each other (FIG. 2*d*).

Figure 3A:
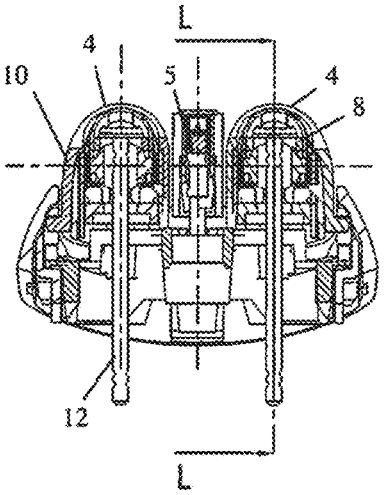
FIG. 3*a* is a sectional view of a shaver head according to a first embodiment of the invention.
Figure 3B:
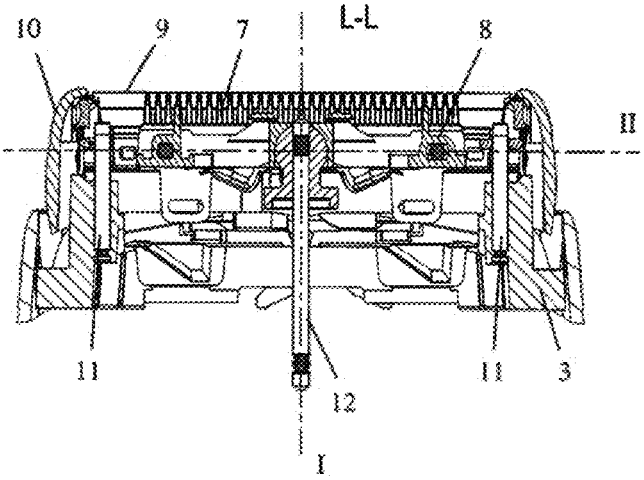
FIG. 3*b* is a further sectional view of the shaver head of FIG. 3*a;*

The general principle of transmitting a force or motion to the cutter units 4 can be understood from FIGS. 3*a* and 3*b*. Each cutter unit 4 comprises a non-foil type lower cutter element 6 with a series of arched blades 7 mounted on a common base 8 and a foil type upper cutter element 9 which is fixed in a frame 10. The frame 10 further guides the lower cutter element 6 allowing relative lateral horizontal translation of the lower cutter element 6 with respect to the stationary upper cutter element 9 parallel to the swiveling axis II while constraining the lower cutter element 6 in a defined position with respect to the upper cutter element 9 in a direction parallel to the vertical axis I and in a direction parallel to the tilting axis III. This reciprocating relative movement of the two cutter elements shears off hairs entering the openings in the foil type upper cutter element 9.

The frame 10 is guided in the shaver head 3 by means of two pins 11 allowing vertical translation and tilting of the frame 10 with respect to the shaver head 3. The housing 2 encases a drive unit (not shown) which may comprise an electric motor with an eccentric driving at least one transmitter 12 which performs a reciprocating lateral horizontal translation in view of the drive train arrangement. The transmitter 12 may have the form of a pin extending parallel to the vertical axis I as shown in FIGS. 3*a* and 3*b*. An oscillating bridge—as known from prior art shavers—is omitted and the drive unit extends from the motor into the head in order directly drive the lower cutter elements. Thus the head and the cutter unit(s) may move and adapt to the skin contour independent from the drive unit. The cutter unit only follows the drive units movements with respect to the oscillation transferred from the motor via the drive unit to the lower cutter.

Figure 3D:
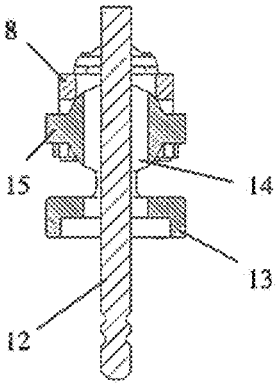
FIG. 3*d* is a sectional view of a detail of the shaver head of FIG. 3*a;*
Figure 3E:
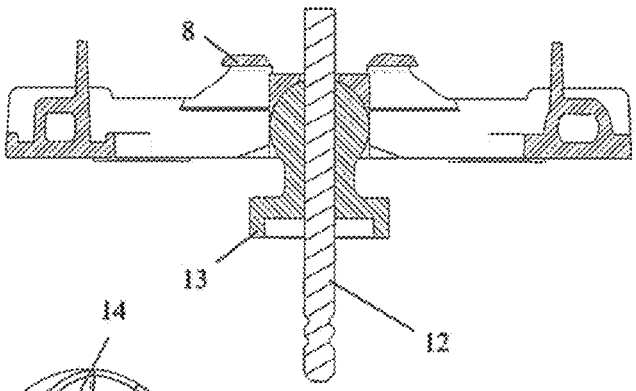
FIG. 3*e* is a further sectional view of a detail of the shaver head of FIG. 3*a;*

Further, FIGS. 3*a* to 3*f* depicts a first embodiment of a coupling between the transmitter pin 12 and the lower cutter element 6. The coupling comprises the transmitter pin 12 and the lower cutter element 6 and in addition a coupling part 13 (FIG. 3*c*) which is interposed between the transmitter pin 12 and the lower cutter element 6. The coupling part 13 has an at least partially spherical upper portion which is guided in a corresponding hemispherical portion of the base 8 of the lower cutter element 6. The lower portion of the coupling part 13 has a flange-like configuration and is adapted to receive a compression spring (not shown) for pushing the coupling part 13 upwards (as seen in FIGS. 3*d* and 3*e*).

Figure 3C:
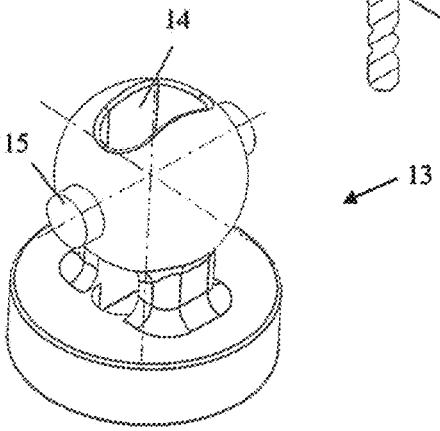
FIG. 3*c* is a perspective view of the coupling part of the shaver head of FIG. 3*a;*

Further, the coupling part 13 comprises a seat for receiving the transmitter pin 12 which has the form of a slotted hole 14 as shown in FIGS. 3*c* to 3*e*. The dimensions of the slotted hole 14 are adapted to the dimension of the transmitter pin 12 such that the width of the slotted hole 14 substantially corresponds to the width of the transmitter pin 12 in a direction parallel to the horizontal swiveling axis II (FIG. 3*e*) whereas the width of the slotted hole 14 exceeds the width of the transmitter pin 12 in the perpendicular direction parallel to the horizontal tilting axis III (FIG. 3*d*). The fit between the transmitter pin 12 and the slotted hole 14 in the direction parallel to the horizontal swiveling axis II is preferably chosen such that the transmitter pin 12 is able to slide within the slotted hole 14 in a direction parallel to the vertical axis I but has substantially no play to provide for transmission of a force or motion in the direction parallel to the horizontal swiveling axis II for driving the lower cutter element 6 upon actuation of the transmitter pin 12. On the other hand, the increased width of the slotted hole 14 in the direction parallel to the horizontal tilting axis III allows pivoting of the coupling part 13 with respect to the transmitter pin 12, in particular if the cutter unit 4 performs a swiveling motion relative to the transmitter pin 12.

Figure 3F:
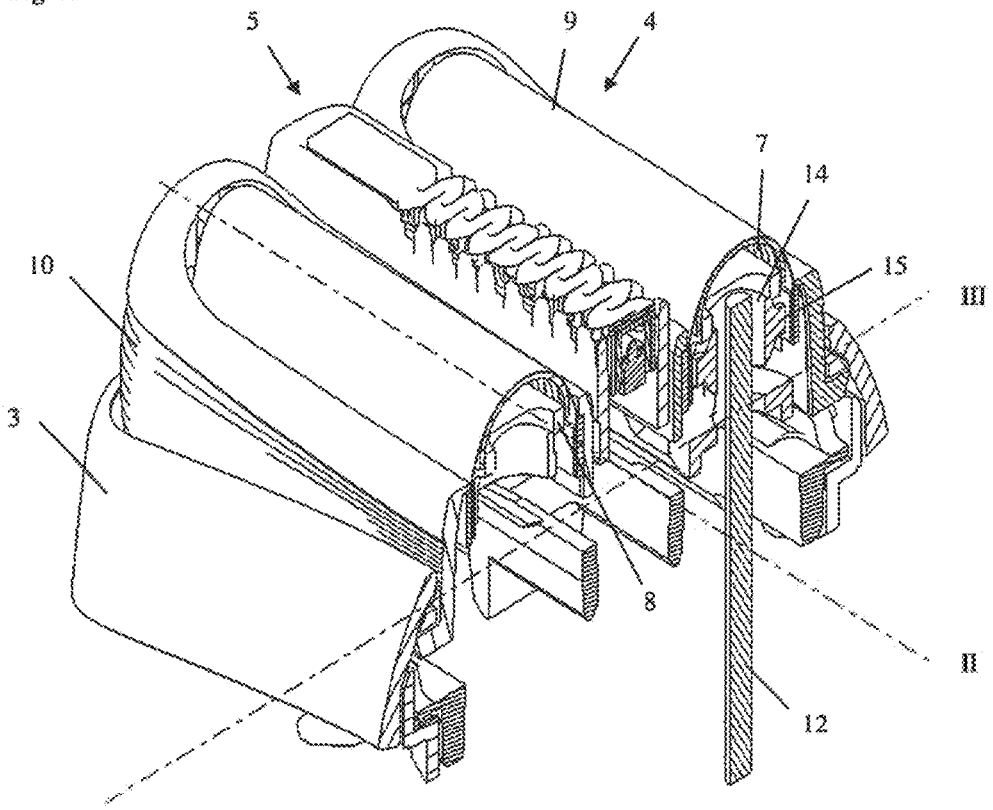
FIG. 3*f* is a perspective partial view of the shaver head of FIG. 3*a;*

The above features of transmitting a force or motion in a direction parallel to the horizontal swiveling axis II while allowing a swiveling of the cutter unit with respect to the transmitter pin 12 requires that the coupling part 13 is held in a predefined orientation with respect to the transmitter pin and/or the lower cutter element 6. This is achieved by providing two lateral guiding elements in the form of pins 15 on the spherical portion of coupling part 13. As can be seen in FIGS. 3*d* and 3*f* the guide pins 15 are received in a corresponding structure in base 8 of the lower cutter element 6 to prevent gyration of the coupling part 13 with respect to the base 8. In other words, the orientation of the slotted hole 14 with respect to the base 8 of the lower cutter element 6 is maintained by the guide pins 15 and the corresponding structure in the base 8.

The coupling between transmitter pin 12 and lower cutter element 6 by means of coupling part 13 of the first embodiment has the effect that a reciprocating force or motion of the transmitter pin 12 for driving the lower cutter element 6 is directly transmitted from the transmitter pin 12 via the slotted hole 14 of the coupling part 13 and via the spherical outer surface of coupling part 13 into the corresponding hemispherical surface of base 8 of the lower cutter element 6. In addition, the lower cutter element 6 may perform a relative movement parallel to the vertical axis I with respect to transmitter pin 12 by transmitter pin 12 sliding within slotted hole 14 of coupling part 13. The structure of the spherical outer surface of coupling part 13 and the corresponding hemispherical surface of base 8 allow a tilting of the lower cutter element 6 with respect to the transmitter pin 12. The design of the slotted hole 14 further allows swiveling of the lower cutter element 6 with respect to transmitter pin 12. Further, a gyration of the lower cutter element 6 with respect to the transmitter pin 12 is allowed. In addition, the design and orientation of the slotted hole 14 allows a relative movement of the lower cutter element 6 with respect to transmitter pin 12 parallel to the horizontal tilting axis III. The latter two relative movements of the lower cutter element 6 with respect to the transmitter pin 12 may be prevented by the frame 10 being guided on pins 11 of the shaver head 3.

Figure 4A:
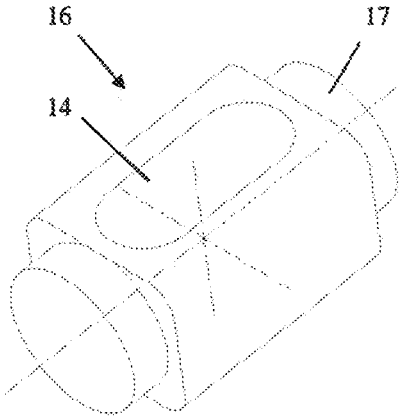
FIG. 4*a* is a perspective view of a coupling part of a shaver head according to a second embodiment of the invention.
Figure 4B:
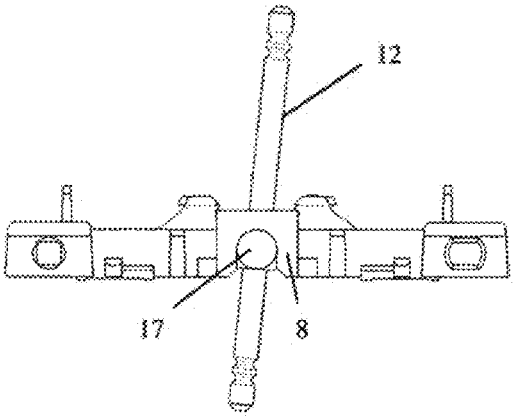
FIG. 4*b* is a side view of a detail of a shaver head with the coupler part of FIG. 4*a;*
Figure 4C:
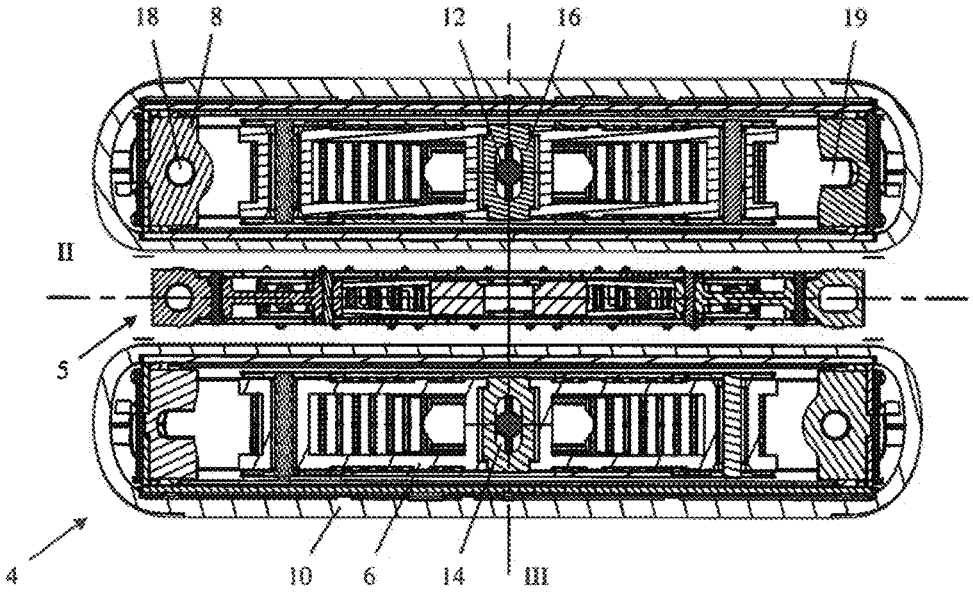
FIG. 4*c* is a sectional top view of a shaver head with the coupler part of FIG. 4*a;*
Figure 4D:
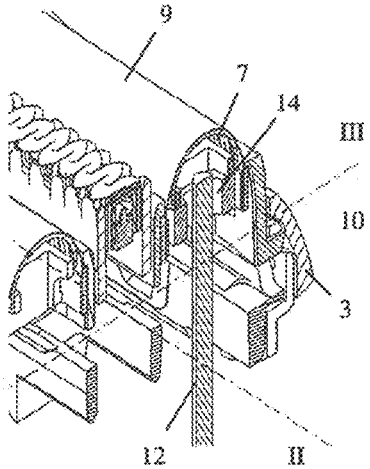
FIG. 4*d* is a perspective partial view of the shaver head of FIG. 4*c;*
Figure 4E:
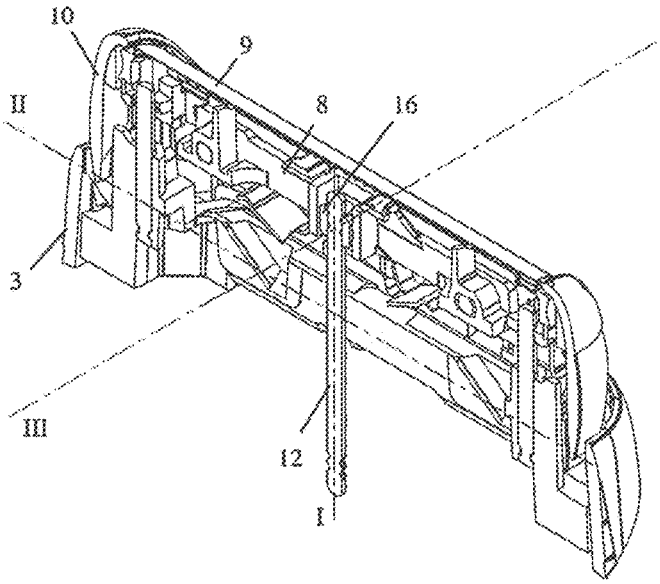
FIG. 4*e* is a further perspective partial view of the shaver head of FIG. 4*c;*

A second embodiment of the present invention is depicted in FIGS. 4*a* to 4*e*. The general composition and function of the respective component parts is identical to the above described first embodiment. However, the design of the coupling part 16 and the respective counter surface in base 8 of the lower cutter element 6 differs from the design of the coupling part 13 of the first embodiment and the respective counter surface in the base 8. As can be seen in FIG. 4*a* coupling part 16 is substantially cylindrical with a middle portion in the form of a cuboid with rounded edges. The lateral cylindrical portions 17 of coupling part 16 are received and guided in a corresponding surface of base 8 of the lower cutter element 6. As can be seen from FIG. 4*b* this corresponding surface may have the form of a cylindrical half shell such that tilting of the lower cutter element 6 with respect to transmitter pin 12 is allowed. In addition, the lateral cylindrical portions 17 of coupling part 16 fulfill the function of the guide pins 15 of coupling part 13 of the first embodiment, i.e. preventing gyration of the coupling part 16 with respect to the lower cutter element 6.

The coupling part 16 further comprises a slotted hole 14 which has a configuration and orientation as mentioned above with respect to the first embodiment. As can be seen from FIG. 4*c* the transmitter pin 12 is guided within the slotted hole 14 of coupling part 16 such that a driving force or motion in a direction parallel to the horizontal swiveling axis II is transmitted, while relative movement in the direction of the perpendicular horizontal tilting axis III or a relative swiveling movement are permitted by the design of the slotted hole 14.

The design and arrangement of the coupling between transmitter 12 and lower cutter element 6 by means of coupling part 16 is such that only one degree of freedom is constrained, namely the lateral horizontal translation parallel to the swiveling axis II, while the five other relative movements, namely the vertical translation, the forward horizontal translation, the gyration, the swiveling and the tilting, are permitted. Due to the interface between shaver head 3 and frame 10 with pins 11 engaging a fixed bearing 18 and a floating bearing 19 gyration and forward horizontal translation between the cutter unit 4 and the transmitter pin 12 are prevented. However, the design of the second embodiment may be amended to allow gyration and/or forward horizontal translation if desired.

Figure 5A:
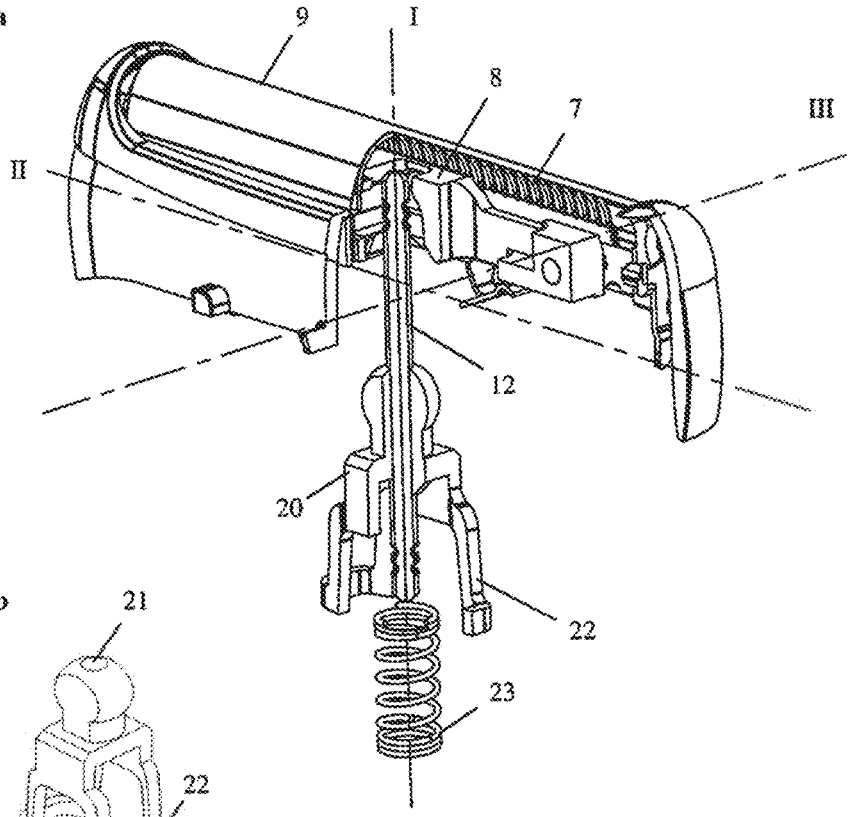
FIG. 5*a* is a perspective partial view of a shaver head according to a third embodiment of the invention.
Figure 5B:
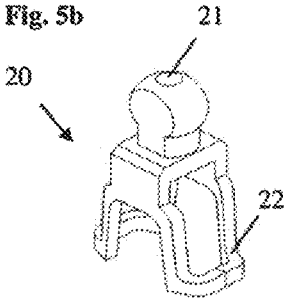
FIG. 5*b* is a perspective view of the coupling part of the shaver head of FIG. 5*a;*
Figure 5C:
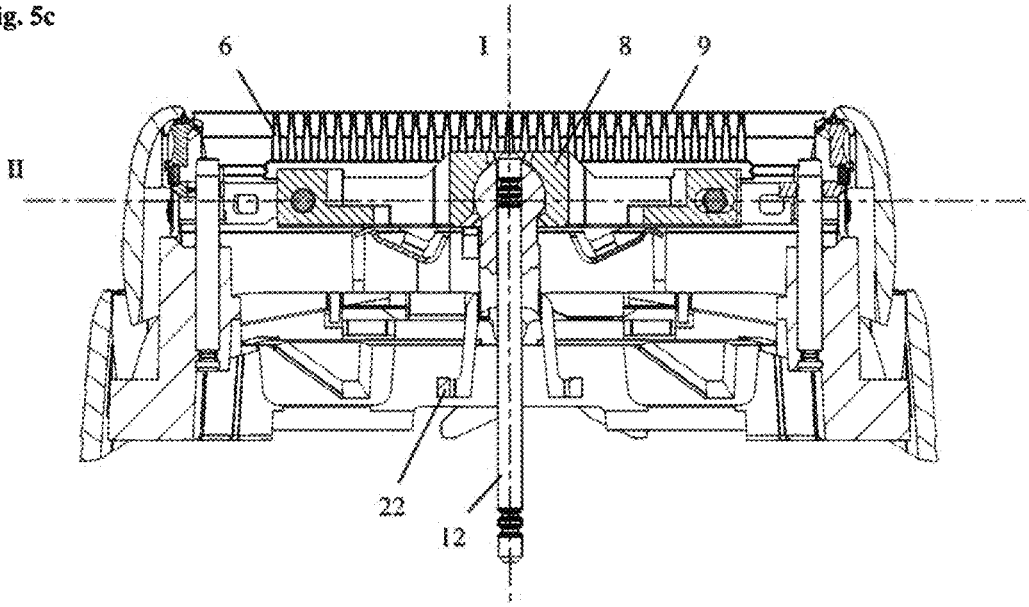
FIG. 5*c* is a sectional view of the shaver head of FIG. 5*a;*
Figure 5D:
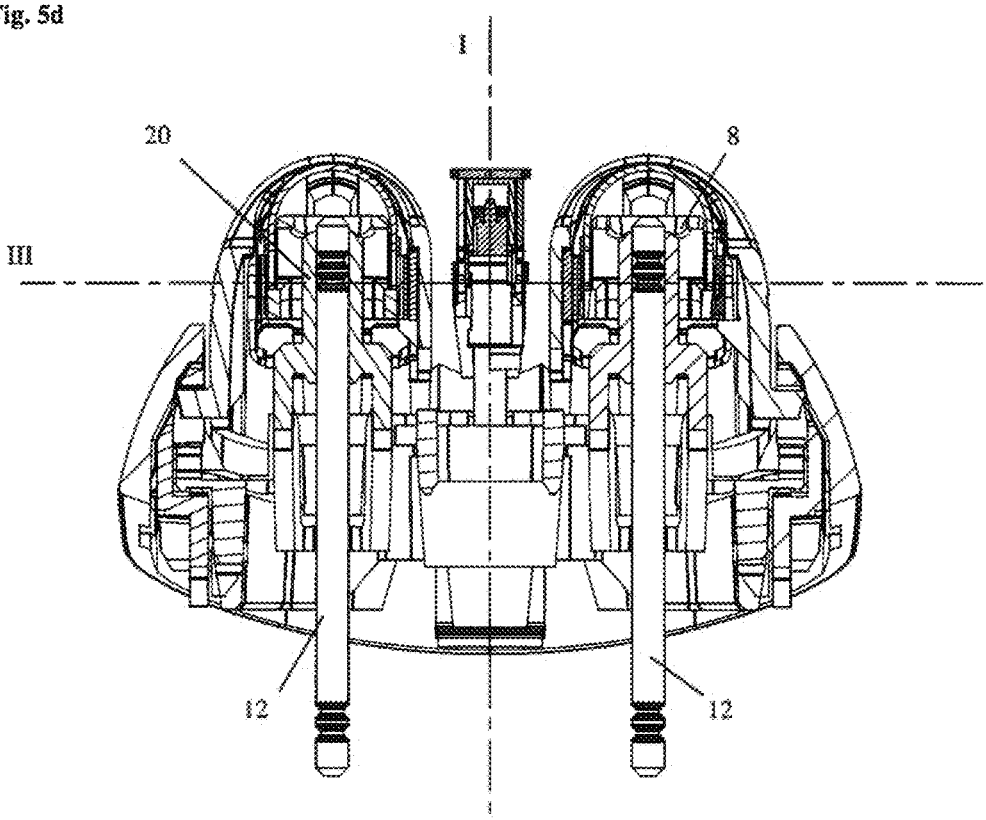
FIG. 5*d* is a further sectional view of the shaver head of FIG. 5*a;*

A third embodiment of the invention is depicted in FIGS. 5*a* to 5*d*. Again, the general composition and function of the shaver head is as described above with respect to the first and second embodiment. The coupling between transmitter pin 12 and the lower cutter element 6 comprises a coupling part 20 with a spherical upper portion which may have flattened lateral sides as shown in FIG. 5*b*. This upper portion of coupling part 20 is received in a corresponding structure of the base 8 of the lower cutter element 6 having the form of a cylindrical half shell in the depicted embodiment. The half shell extends with its longitudinal axis parallel to the horizontal tilting axis III. As an alternative to the depicted embodiment a hemispherical configuration of the corresponding structure of the base 8 of the lower cutter element 6 may be possible.

The coupling part 20 comprises a circular hole 21 receiving the transmitter pin 12. The inner diameter of the circular hole 21 substantially corresponds to the outer diameter of transmitter pin 12 to allow direct transmission of a driving force or motion from the transmitter pin 12 to the coupling part 20 and further to the lower cutter element 6 while allowing a sliding vertical translation of coupling part 20 with respect to transmitter pin 12. As an alternative to the circular design of transmitter pin 12 and hole 21 any other design may be possible which allows transmission of a lateral horizontal translation.

The lower portion of coupling part 20 has a flange-like configuration with two legs 22 extending away from the spherical upper portion. As shown in FIG. 5*a* a compression spring 23 may be received in the flange-like portion between legs 22 and surrounding transmitter pin 12. With the shaver head 3 attached to the housing 2 of an electric shaver legs 22 preferably engage hocks (not shown) which may be provided on a portion of the drive train surrounding transmitter pin such that a relative vertical translation of coupling part 20 with respect to the hocks is allowed while preventing gyration of coupling part 20.

Again, the design and arrangement of the coupling of the third embodiment is such that a relative lateral horizontal translation between transmitter pin 12 and lower cutter element 6 is prevented, while a relative vertical translation, a forward horizontal translation, a gyration, a swiveling and a tilting is allowed. As mentioned above, the forward horizontal translation and the gyration may be prevented by means of the interface between frame 10 and shaver head 3.

Figure 6A:
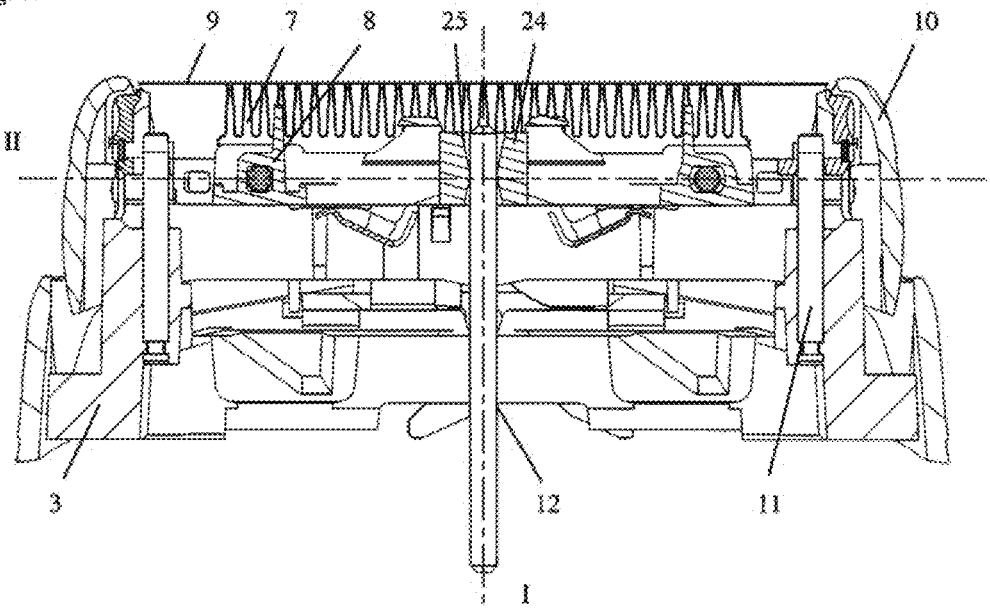
FIG. 6*a* is a sectional view of a shaver head according to an alternative.
Figure 6B:
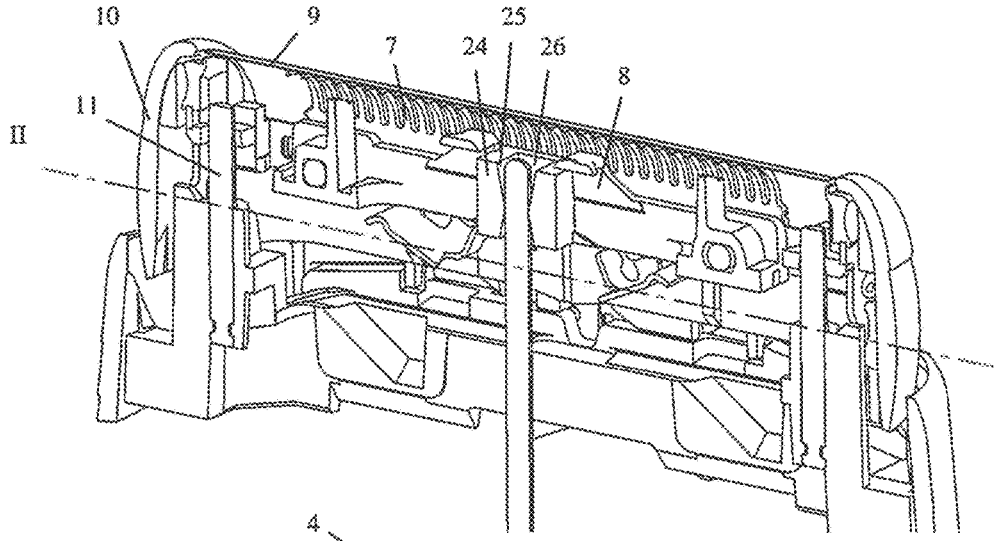
FIG. 6*b* is a perspective partial view of the shaver head of FIG. 6*a;*
Figure 6C:
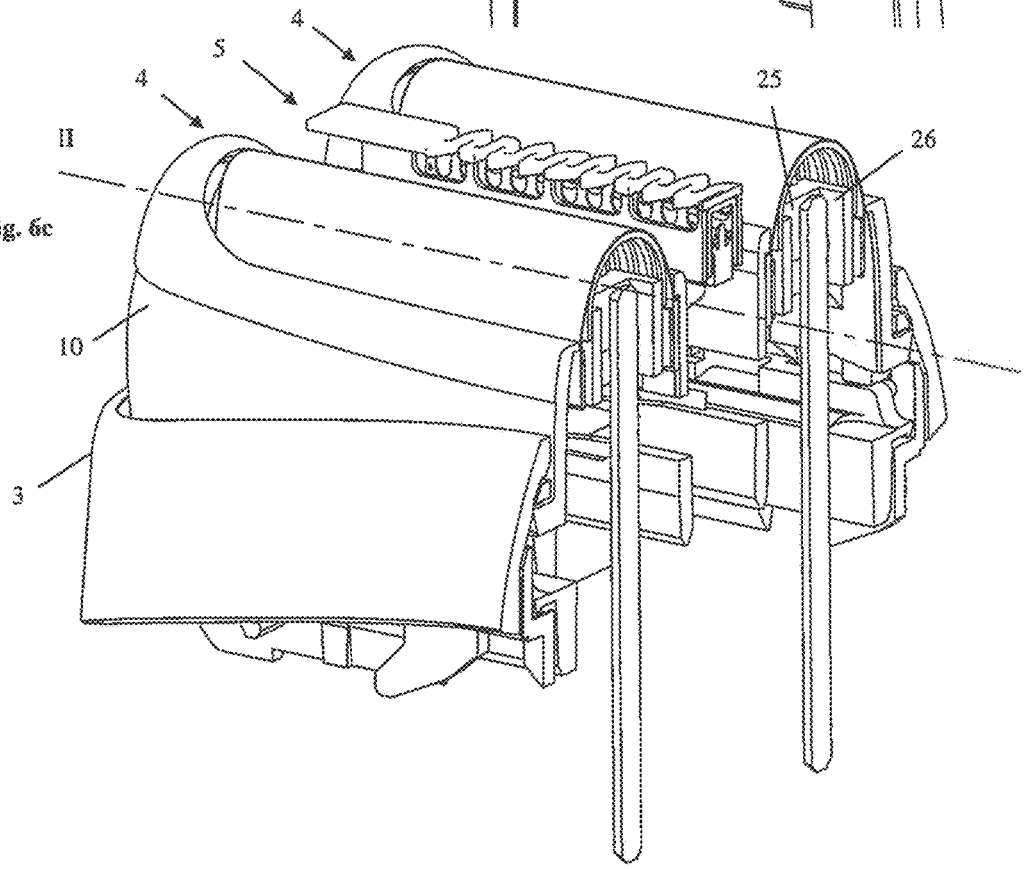
FIG. 6*c* is a further perspective partial view of the shaver head of FIG. 6*a;*
Figure 7A:
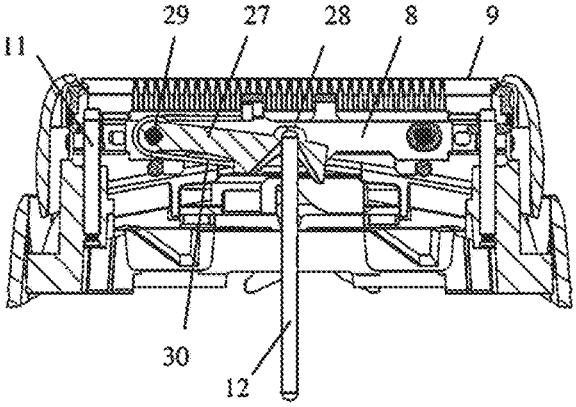
FIG. 7*a* is a sectional view of a shaver head according to an alternative.
Figure 7B:
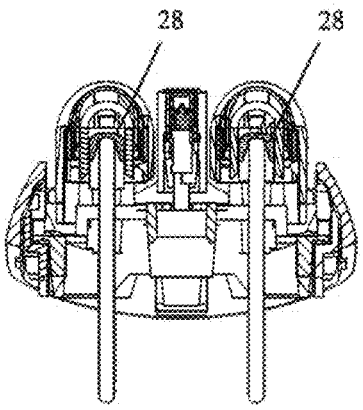
FIG. 7*b* is a further sectional view of the shaver head of FIG. 7*a;*
Figure 7C:
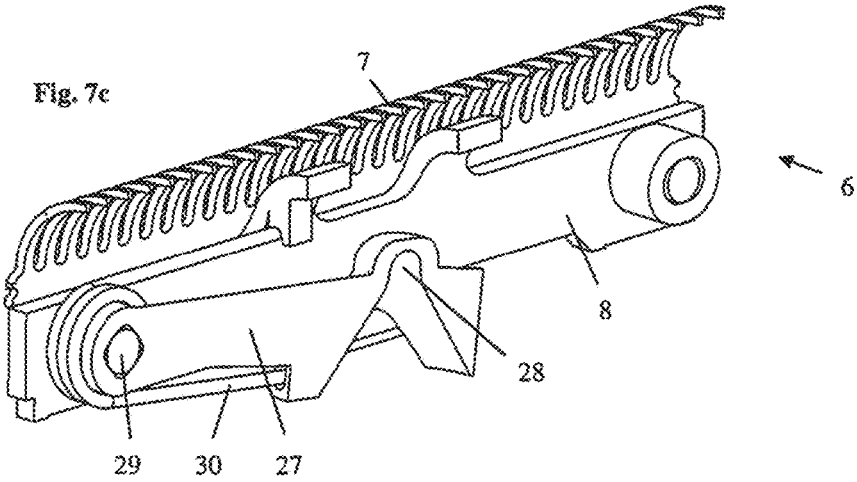
FIG. 7*c* is a perspective partial view of a detail of the shaver head of FIG. 7*a;*
Figure 7D:
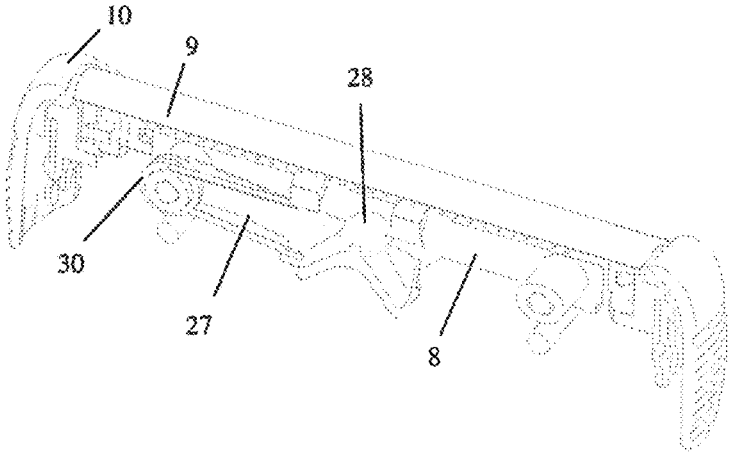
FIG. 7*d* is a further perspective partial view of a detail of the shaver head of FIG. 7*a;*

An alternative is depicted in FIGS. 6*a* to 6*c* which differs from the above mentioned embodiments in that a coupling part 24 is not a separate component part but an integral portion of the base 8 of the lower cutter element 6.

The coupling part 24 is defined by two apposed side surfaces 25 which are arranged on opposite sides as seen in the direction of the horizontal swiveling axis II. In the embodiment depicted in FIGS. 6*a* to 6*c* the side surfaces 25 are roof-shaped with two portions which are inclined with respect to the vertical axis I and which form an obtuse angle with respect to each other. As an alternative, the side surfaces 25 may have a bent configuration or may be formed by portions forming an acute angle. Such a design of the side surfaces results in the coupling part 24 defining a slotted hole for receiving the transmitter pin 12. As can be seen in FIGS. 6*a* and 6*b* the arrangement of the side surfaces 25 is such that a middle portion of the slotted hole 26 has a width substantially corresponding to the width of the transmitter pin 12 in the direction of the horizontal swiveling axis II, while the width of the slotted hole 26 exceeds the width of the transmitter pin 12 in an upper portion and in a lower portion. Further, the width of the slotted hole 26 exceeds the width of the transmitter pin 12 in a direction parallel to the tilting axis III. The transmitter pin 12 is guided in the slotted hole 26 to allow vertical translation and forward horizontal translation of base 8 with respect to transmitter pin 12 while blocking relative lateral horizontal translation. In addition, gyration, swiveling and tilting of base 8 with respect to transmitter pin 12 is allowed by due to the design and arrangement of the side surfaces 25.

A further alternative is depicted in FIGS. 7*a* to 7*d*. While the general composition and function of the component parts of the shaver head 3 is identical to the above described embodiments, the coupling between the transmitter pin 12 and the lower cutter element 6 differs in the provision of a coupling part in the form of a con-rod 27 having a bearing shell 28 at one end. The con-rod 27 is attached to the base 8 of the lower cutter element 6 with its opposite end by means of a pivot bearing 29. A leg spring 30 engages the con-rod 27 and the base 8 of the lower cutter element 6, thereby biasing the bearing shell 28 away from the lower cutter element 6.

In the depicted embodiment the bearing shell 28 has the form of a hemisphere passing into a truncated cone. The bearing shell 28 receives the upper end of transmitter pin 12 which may have a rounded tip. The transmitter pin 12 is guided within bearing shell 28 such that a lateral horizontal translation is transmitted from the transmitter pin 12 via the con-rod 27 to the base 8 of lower cutter element 6. However, gyration, swiveling and tilting of the transmitter pin 12 with respect to bearing shell 28 is permitted. In addition, a vertical translation of the lower cutter element 6 with respect to the transmitter pin 12 is permitted by pivoting con-rod 27 against the bias of leg spring 30.

In the exemplary embodiments depicted in the figures, the coupling between the transmitter pin 12 and the lower cutter element 6 is identical for both cutter units 4. However, different interfaces between the transmitter pin 12 and a cutter unit 4 may be provided if desired to allow differing relative movements between the cutter unit and the transmitter pin. Cutter unit 5 may be driven together with one of the cutter units 4 by a common transmitter pin 12.

It is a common feature of the above described embodiments that the coupling is designed to allow relative vertical translation, relative forward horizontal translation, relative gyration, relative swiveling and/or relative tilting of a cutter unit with respect to a transmitter pin on a macro level, i.e. based on a movement of the whole shaver head 3 with respect to the housing 2, and/or on a micro level, i.e. based on a movement of a cutter unit 4, 5 relative to the shaver head 3. This permits a perfect adaption of the position of each individual cutter unit 4, 5 with respect to the contour of the skin to be shaved.

Figure 8A:
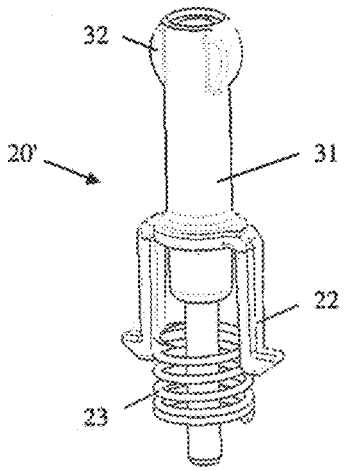
FIG. 8*a* is a perspective view of the coupling element according to a fourth embodiment of the invention.
Figure 8D:
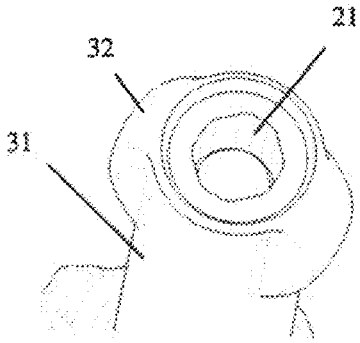
FIG. 8*d* is a further perspective view of the coupling element of FIG. 8*a;*

The embodiment of FIGS. 8*a* to 8*d* corresponds mainly to the embodiment of FIGS. 5*a* to 5*d* with an amended design of the interface between the coupling part 20' and the cutter element 6. In more detail, the coupling part 20' comprises a neck portion 31 which may be cylindrical as shown in FIG. 8*a*. The upper end (as seen in FIG. 8*a*) of the neck portion 31 is provided with two laterally extending protrusions 32 in the form of arcs each forming a cylinder segment. The cutter element 6 is provided with a corresponding guidance chamber having two opposite arced portions 33 forming corresponding cylinder segments. As can be seen in FIG. 8*d*, the hole 21 in the coupling part 20' receiving the transmitter 12 may have a polygonal shape instead of a circular shape as shown in FIG. 5*b*.

Figure 9A:
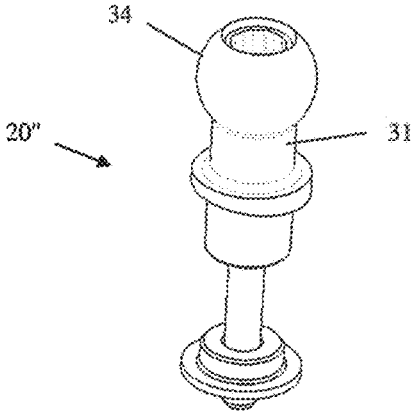
FIG. 9*a* is a perspective view of the coupling element according to a fifth embodiment of the invention.
Figure 8B:
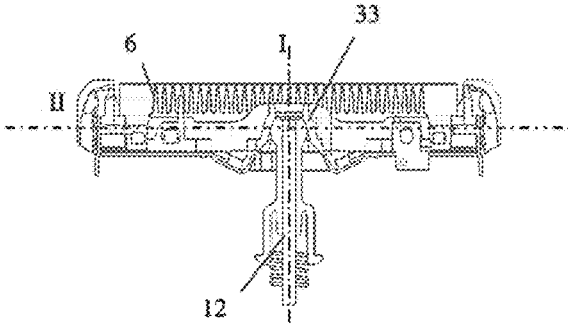
FIG. 8*b* is a sectional view of a shaver head with the coupling element of FIG. 8*a;*
Figure 9B:
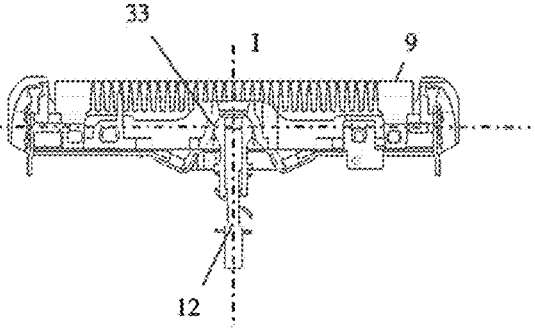
FIG. 9*b* is a sectional view of a shaver head with the coupling element of FIG. 9*a;*
Figure 8C:
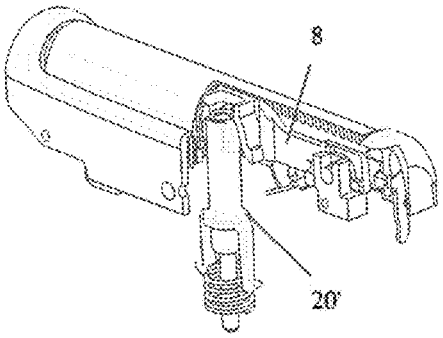
FIG. 8*c* is a further sectional view of a shaver head with the coupling element of FIG. 8*a;*
Figure 9C:
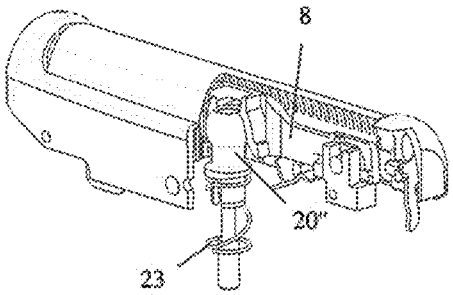
FIG. 9*c* is a further sectional view of a shaver head with the coupling element of FIG. 9*a;*

The embodiment of FIGS. 9*a* to 9*c* differs only slightly from the embodiment of FIGS. 8*a* to 8*d* regarding the design of the interface between the coupling part 20" and the cutter element 6. In FIGS. 9*a* to 9*c* the neck portion 31 of the coupling part 20" is provided with an end in the form of a ball segment 34, which is received in a corresponding guidance chamber having two opposite arced portions 33 forming corresponding cylinder segments.

Figure 10A:
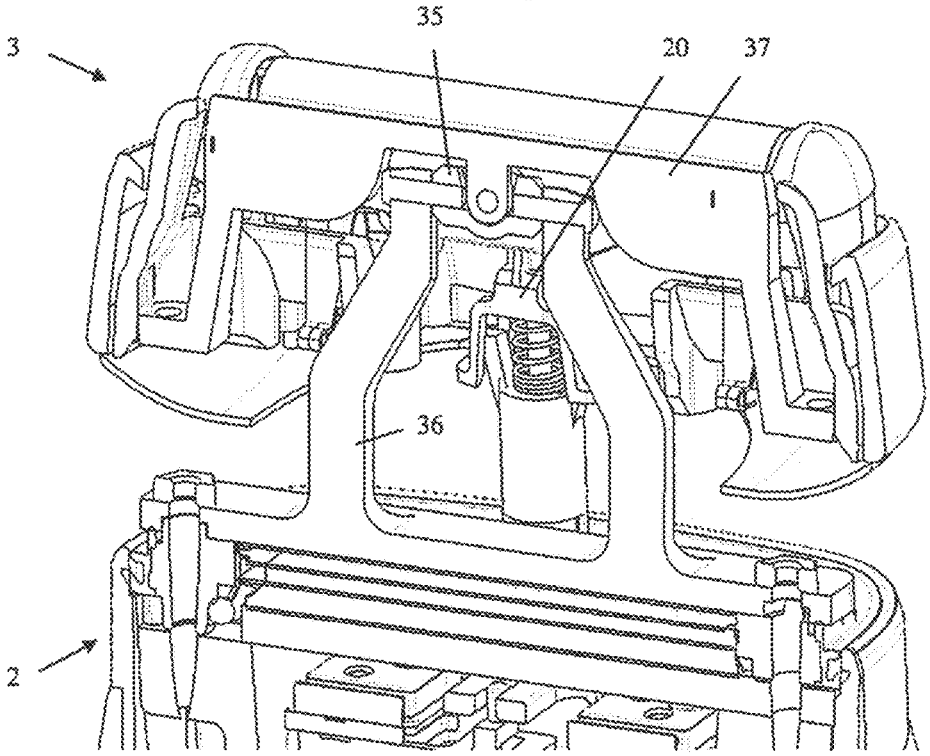
FIG. 10*a* is a sectional view of a shaver head according to a sixth embodiment of the invention.
Figure 10B:
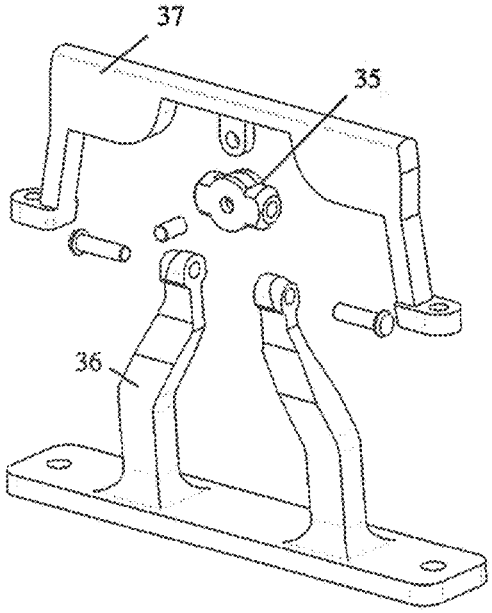
FIG. 10*b* is a perspective view of the shaver head of FIG. 10*a*.

FIG. 10*a* and 10*b* depict how a shaver head 3 may be mounted on housing 2 of the shaver 1 by means of a gimbal element 35. The gimbal element 35 is pivotably mounted on arms 36 fixed to the housing 2 and the head 3 is in turn pivotably mounted on the gimbal element 35. In the embodiment of FIG. 10*a* and 10*b*, the gimbal element 35 is pivotable about horizontal swiveling axis II with respect to arms 36 of the housing 2. Further, the head 3 is pivotable about horizontal tilting axis III with respect to gimbal element 35. Alternatively to that gimbal type head movability the afore described coupling between the transmitter and the lower cutter element may be combined with any other type of means for allowing the complete head to swivel around the horizontal swivel axis and to tilt around the horizontal tilting axis. For example the head may swivel around a pivot point provided on a u-shaped head support frame (not shown) on both sides of the head and the head support frame with the head may tilt around a pivot point or by a 4-link mechanism connecting the handle with the head support frame.

As described above the complete head may be supported relative to the handle to swivel and/or tilt. By this head movability the head may adapt to the skin contour in a larger scale which may be named macro-adaption. This may be optionally combined with a micro-adaptation of the cutting units to the skin contour. The micro-adaptation is a movement of the cutting unit 4, 5 and the frame 10 within the head and is therefore provided independent from the complete head movability. The following micro adaption movability of the cutter units relative to the head (housing) may be provided combined or not combined: floating as a movement along the vertical axis of the transmitter, swivel around a horizontal swivel axis and tilt around a horizontal tiling axis.

Figure 11:
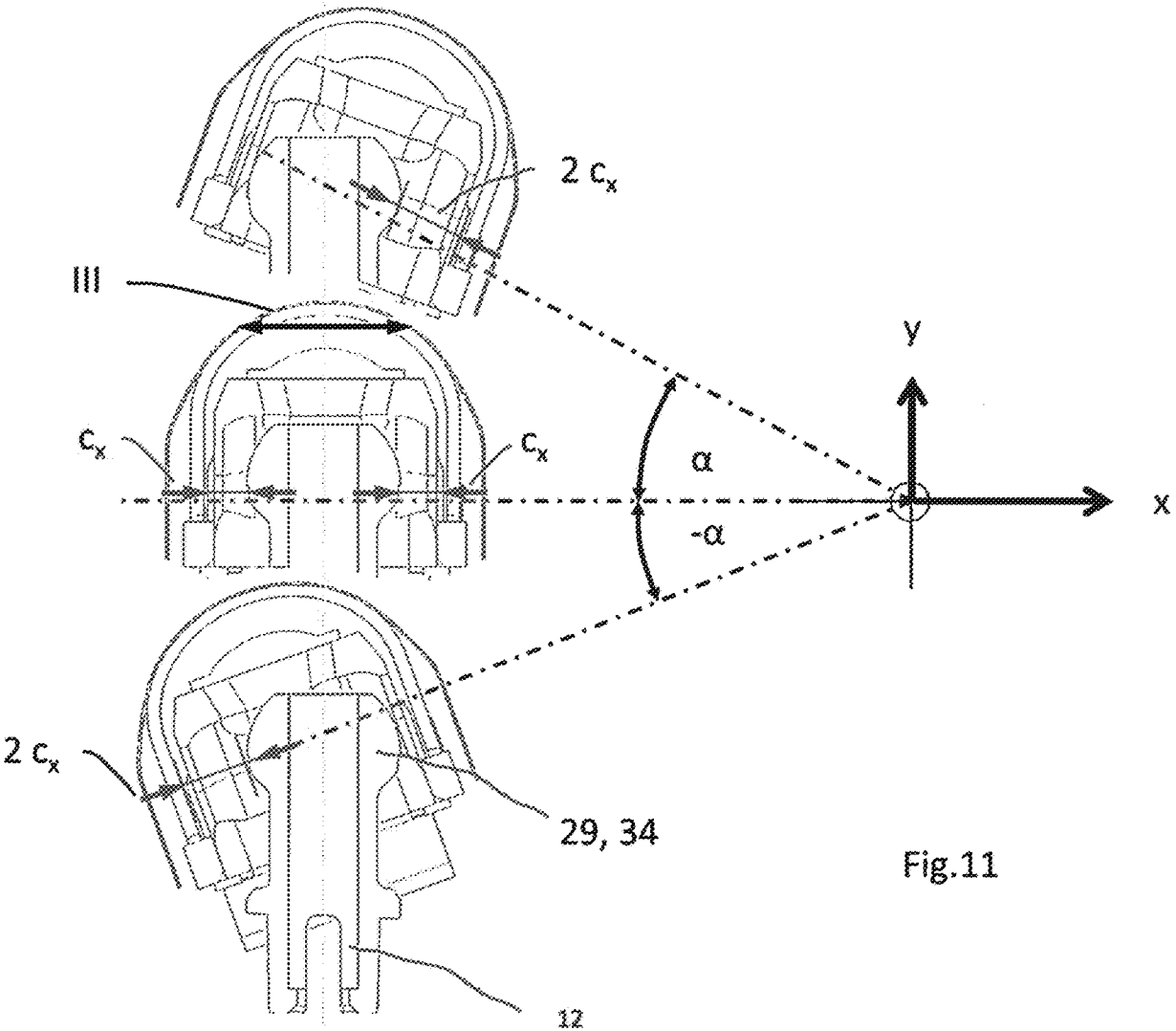
FIG. 11 is a schematic cross-sectional view through the coupling area in 3 different angular head swivel position.

The transverse displacement of the coupling and transmitter relative to the lower cutter element 6 is further illustrated by FIG. 11 showing the cutter element 6 in three different angular positions which are reached when swiveling the shaver head 3 relative to handle 2 about swivel axis II. As shown by FIG. 11, the swivel angle $\alpha$ may be, for example, +/−5° or +/−10° or +/−15° or may range from +/−5° to +/−15°. Due to the position of the swivel axis II spaced apart from the coupling part or more specifically the ball segment of the coupling part—as it may be the case when the swivel axis II is positioned between a pair of cutter units 4, 5, for example—the lower cutter element 6 is displaced relative to the pivot in a direction 111 transverse to the drive pin's vertical axis I and transverse to the swivel axis II. In FIG. 11, reference $c_x$ designates the clearance in such transverse direction 111 as provided by the slotted hole 26 and the length L thereof. Such clearance $c_x$ may range from +/−0.7 mm to 1 mm or from +/−0.7 mm to +/−1.2 mm, thus in total ranging from 1 mm to 2.4 mm In addition or in the alternative to the transverse displacement caused by swiveling movements as shown by FIG. 11, similar transverse movements in the direction 111 may also be caused by the circular path of driven reciprocation of the coupling which does not exactly execute a linear oscillation, but executes a rotatory oscillation about the vertical axis. Thus the degree of freedom between the lower cutter element and the coupling part—in at least one translational direction in which both parts are not constrained but provided with a degree of freedom to perform a translational movement relative to one another—is more than 3% or more preferably more than 5% of the size of the extension of the coupling part in the same translational direction.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

List of reference signs:

| | |
|---|---|
| 1 | electrical shaver |
| 2 | housing |
| 3 | shaver head |
| 4 | cutter unit |
| 5 | cutter unit |
| 6 | lower cutter element |
| 7 | blade |
| 8 | base |
| 9 | upper cutter element |
| 10 | frame |
| 11 | pin |
| 12 | transmitter pin |
| 13 | coupling part |
| 14 | slotted hole |
| 15 | guide pin |
| 16 | coupling part |
| 17 | lateral cylindrical portion |
| 18 | fixed bearing |
| 19 | floating bearing |
| 20 | coupling part |
| 20' | coupling part |
| 20" | coupling part |
| 21 | circular hole |
| 22 | leg |
| 23 | compression spring |
| 24 | coupling part |
| 25 | side surface |
| 26 | slotted hole |
| 27 | con-rod |
| 28 | bearing shell |
| 29 | pivot bearing |
| 30 | leg spring |
| 31 | neck portion |
| 32 | protrusion |
| 33 | arced portion |
| 34 | ball segment |
| 35 | gimbal element |
| 36 | arm |
| I | vertical axis |
| II | horizontal swiveling axis |
| III | horizontal tilting axis |

What is claimed is:

1. A shaver coupling for transmitting a driving movement from an oscillating transmitter of an electric shaver, which transmitter extends at least in part along a vertical axis, to a cutter element, which extends and moves along a horizontal swiveling axis perpendicular to the vertical axis, the coupling comprising the transmitter, the cutter element and a coupling part, wherein the coupling part comprises a seat for receiving the transmitter, wherein the transmitter, the cutter element and the coupling part are arranged and formed such that the cutter element is constrained to the transmitter in a direction parallel to the horizontal swiveling axis while having a degree of freedom in at least two rotational directions and in at least one translational direction parallel to the vertical axis, wherein the transmitter comprises a pin extending along the vertical axis, and wherein the seat of the coupling part is a slotted hole having a width in the direction of the horizontal swiveling axis which corresponds to the width of the transmitter pin in the direction of the horizontal swiveling axis and having a width in the direction of a horizontal tilting axis which exceeds the width of the transmitter pin in the direction of the horizontal tilting axis, wherein the tilting axis is perpendicular to the horizontal swiveling axis II and perpendicular to the vertical axis.

2. The shaver coupling according to claim 1, wherein the transmitter 12 directly abuts the coupling part.

3. The shaver coupling according to claim 1, wherein the coupling part comprises an at least in part spherical, cylindrical or ball-shaped outer surface and that the cutter element comprises a guidance chamber for receiving the outer surface such that the cutter element is constrained to the coupling part in a direction parallel to the horizontal swiveling axis while having a degree of freedom in at least two rotational directions and in at least one translational direction parallel to the vertical axis.

4. The shaver coupling according to claim 3, wherein the guidance chamber comprises a corresponding contact surface for contacting the outer surface of the coupling part at least along one or more contact lines.

5. The shaver coupling according to claim 4, wherein the guidance chamber comprises a corresponding contact surface for contacting the outer surface of the coupling part along at least one contact face.

6. The shaver coupling according to claim 5, wherein the corresponding contact surface is at least in part spherical, cylindrical or ball-shaped.

7. The shaver coupling according to claim 1, wherein the coupling part is rotatable relative to the transmitter around the vertical axis.

8. The shaver coupling according to claim 1, wherein the coupling part is rotationally constrained to the cutter element in the rotational direction around the vertical axis.

9. The shaver coupling according to claim 1, wherein the coupling part and the cutter element 6 comprise corresponding guide elements limiting the angle of relative rotation around the vertical axis I.

10. The shaver coupling according to claim 1, wherein the coupling part comprises a bearing shell receiving the free end of the transmitter, wherein the bearing shell is mounted to the cutter element via a connecting rod which is pivotable about an axis perpendicular to the horizontal swiveling axis and perpendicular to the vertical axis.

11. The shaver coupling according to claim 1, wherein the degree of freedom between the lower cutter element and the coupling part is more than about 3% of the size of the extension of the coupling part in the same translational direction.

12. An electric shaver comprising at least one cutter unit with a foil type upper cutter and a blade type lower cutter, a drive unit for generating an oscillating movement of at least one transmitter and a coupling according to claim 1, which couples the transmitter to the blade type lower cutter.

13. The electric shaver according to claim 12, wherein the at least one cutter unit is supported by a frame which is detachably mounted to the drive unit wherein when the coupling couples the transmitter to the blade type lower cutter, the frame with the cutter unit is movable relative to the drive unit in a direction parallel to the vertical axis and rotatable relative to the drive unit about the horizontal swiveling axis and about a horizontal tilting axis which is perpendicular to the horizontal swiveling axis and perpendicular to the vertical axis.

14. The electric shaver according to claim 13, further comprising a housing, a head and a gimbal element, wherein the gimbal element is hinged in a pivotable manner to the housing and hinged in a pivotable manner to the head, wherein the cutter elements are arranged on or in the head.

15. A shaver coupling for transmitting a driving movement from an oscillating transmitter of an electric shaver, which transmitter extends at least in part along a vertical axis, to a cutter element, which extends and moves along a horizontal swiveling axis perpendicular to the vertical axis, the coupling comprising the transmitter, the cutter element and a coupling part, wherein the coupling part comprises a seat for receiving the transmitter, wherein the transmitter, the cutter element and the coupling part are arranged and formed such that the cutter element is constrained to the transmitter in a direction parallel to the horizontal swiveling axis while having a degree of freedom in at least two rotational directions and in at least one translational direction parallel to the vertical axis, wherein the cutter element comprises a series of arched blades fixed on a common base, which base forms the coupling part, wherein the coupling part comprises a slotted hole having two side surfaces situated opposed to each other in the direction of the horizontal swiveling axis II which are inclined and/or bent such that a middle portion of the slotted hole has a width in the direction of the horizontal swiveling axis which corresponds to the width of the transmitter pin in the direction of the horizontal swiveling axis and at least one of an upper portion and a lower portion of the slotted hole each have a width in the direction of the horizontal swiveling axis exceeding the width of the transmitter pin in the direction of the horizontal swiveling axis, and wherein the slotted hole has a width in the direction of a horizontal tilting axis which exceeds the width of the transmitter pin in the direction of the horizontal tilting axis, wherein the horizontal tilting axis is perpendicular to the horizontal swiveling axis and perpendicular to the vertical axis.

16. An electric shaver comprising a head and a handle, at least one cutter unit with a foil type upper cutter and a blade type lower cutter, a drive unit for generating an oscillating movement of at least one transmitter and a coupling which couples the transmitter to the blade type lower cutter, wherein the head being movably supported relative to the handle around a horizontal swivel axis and/or around a horizontal tilt axis, said swivel axis is parallel to the lower cutter movement directions and said horizontal tilt axis III is perpendicular to said horizontal swivel axis II and wherein spring means 23 are provided for returning the head into a neutral, non-inclined position with respect to the swivel axis and/or the tilt axis characterized in that said lower cutter 6 is forced against said upper cutter 9 by spring means 23 which at least in part contributes to the spring means 23 for returning the head into a neutral position with respect to at least a head swivel and/or tilt movability, wherein the transmitter comprises a pin extending along the vertical axis, and wherein the seat of the coupling part is a slotted hole having a width in the direction of the horizontal swiveling axis which corresponds to the width of the transmitter pin in the direction of the horizontal swiveling axis and having a width in the direction of a horizontal tilting axis which exceeds the width of the transmitter pin in the direction of the horizontal tilting axis, wherein the tilting axis is perpendicular to the horizontal swiveling axis II and perpendicular to the vertical axis.

* * * * *